United States Patent [19]

Blumberg et al.

[11] Patent Number: 5,013,395

[45] Date of Patent: May 7, 1991

[54] CONTINUOUS REGENERATION OF ACID SOLUTION

[75] Inventors: Lawrence R. Blumberg, Johnson City; Douglas D. Coolbaugh, Newark Valley; John A. Kurowski, Chenango Forks, all of N.Y.; Eugene A. Stromecki, Monmouth Junction, N.J.

[73] Assignee: International Business Machines Corporation, Armonk, N.Y.

[21] Appl. No.: 91,009

[22] Filed: Aug. 28, 1987

[51] Int. Cl.[5] ..... C23F 1/02

[52] U.S. Cl. ..... 156/627; 156/642; 156/664; 156/666

[58] Field of Search ..... 156/642, 345, 664, 666, 156/627, 626; 422/187; 134/10, 3; 137/391

[56] References Cited

U.S. PATENT DOCUMENTS

| | | | |
|---|---|---|---|
| 2,908,557 | 10/1959 | Black et al. | 41/42 |
| 3,600,244 | 8/1971 | Wegener | 156/19 |
| 3,855,141 | 12/1974 | Ruff | 252/79.2 |
| 3,880,685 | 4/1975 | Rehm et al. | 156/19 |
| 3,964,956 | 6/1976 | Snyder | 156/345 |
| 4,042,444 | 8/1977 | Snyder | 156/642 X |
| 4,388,276 | 6/1983 | Konstantouros et al. | 156/642 X |

FOREIGN PATENT DOCUMENTS

| | | |
|---|---|---|
| 2008766 | 2/1970 | Fed. Rep. of Germany . |
| 2241462 | 8/1972 | Fed. Rep. of Germany . |
| 1367203 | 8/1963 | France . |
| 106781 | 5/1986 | Japan . |

OTHER PUBLICATIONS

Evaluation of a Packed Tower for Oxidation of Cuprous Ion in IBM Copper Etching Solution, by Kenneth J. McNulty and Chang-Li Hsieh, Koch Membrane Systems, Inc., Wilmington, MA, 2/22/85.

*Primary Examiner*—David A. Simmons
*Assistant Examiner*—Thi Dang
*Attorney, Agent, or Firm*—Judith D. Olsen

[57] ABSTRACT

A method of continuously regenerating a metal containing acid solution enhanced with a salt-free material. The metal dissolved in a bulk metal containing acid solution is continuously oxidized by introducing a gas into a packed reaction vessel. The packed reaction vessel is in operative relationship with the bulk acid solution for recirculating regenerated solution and for receiving spent solution. The gas is introduced substantially cocurrently with the spent acid solution.

13 Claims, 1 Drawing Sheet

CONTINUOUS REGENERATION OF ACID SOLUTION

BACKGROUND OF THE INVENTION

The present invention relates to a method of regenerating a solution and, more particularly, to a method of regenerating an acid etching solution which is enhanced with a salt-free material.

Cupric chloride solutions have conventionally been used to etch printed circuits. The chemical formulation for cupric chloride is $Cu^{(+2)}Cl_2$. The usual etching procedure involves placing a resist pattern over a sheet of copper laminated to one or both sides of a plastic/-glass cloth core. The masked copper laminate is then brought into contact with the etching solution which dissolves the exposed copper and leaves behind the copper which is protected by the resist pattern. When the cupric chloride etches away the copper from the laminated substrate, cuprous chloride is produced in accordance with the following etching reaction:

$$Cu^{(0)} + Cu^{(+2)}Cl_2 \rightarrow 2Cu^{(+1)}Cl$$

In order to continue the etching process, the cuprous chloride must be regenerated to the cupric chloride form before it is again suitable as an etching agent. To regenerate cuprous chloride, it must be oxidized.

U.S. Pat. No. 3,306,792 issued to Thurmel et al teaches a regeneration method in which etching and regeneration occur in separate devices. Oxidation of a salt-based (ammonium chloride) cupric chloride solution is accomplished by sparging air into a separate vessel containing the solution.

U.S. Pat. No. 3,705,061 issued to King teaches an apparatus for continuously regenerating an alkaline etch solution used to dissolve copper from substrates. The continuous reduction/oxidation (redox) process is accomplished by means of spraying the alkaline etch solution countercurrently with air into a reaction vessel.

These oxidation processes are very inefficient for regeneration of large volumes of dissolved copper. Typically the reactions occur at an unacceptable rate for industry.

Other typical methods for regeneration (oxidation) include the addition of chlorine gas in accordance with the following regeneration reaction:

$$Cu^{(+1)}Cl + 1/2\ Cl_2 \rightarrow Cu^{(+2)}Cl_2$$

or by the addition of liquid hydrogen peroxide in accordance with the following regeneration reaction:

$$Cu^{(+1)}Cl + 1/2\ H_2O_2 \rightarrow Cu^{(+2)}Cl_2 + H_2O$$

Either of the aforementioned last two methods can regenerate large capacity etching systems, some of which being capable of etching at a rate of up to 12,000 grams of copper/hour. The speed of these regeneration processes is due to the great speed with which both chlorine and hydrogen peroxide react with cuprous chloride.

There are, however, serious drawbacks associated with the use of conventional methods of regenerating cuprous chloride when industrial environments are contemplated. One of the drawbacks involves handling difficulty. Chlorine gas is typically delivered in 2,000 lb. containers. Great effort must be exercised to move such volumes of the poisonous gas safely.

Toxicity poses a second drawback. Concentrated hydrogen peroxide (30%) that must be added to bulk systems represents a safety hazard to humans for two main reasons: not only is hydrogen peroxide highly corrosive to skin, but contamination of hydrogen peroxide can lead to its rapid decomposition and violent explosion.

It would be advantageous to provide a method of regenerating metal etching solutions safely.

It would further be advantageous to provide a method of regenerating metal etching solutions in an efficient manner for large scale manufacturing operations.

It would also be advantageous to provide a method of regenerating cupric chloride etching solutions without endangering human welfare.

It would further be advantageous to provide a method of regenerating cupric chloride etching solutions by the use of a packed reaction vessel.

It would also be advantageous to provide a method of regenerating cupric chloride etching solutions by introducing an oxygen containing gas cocurrently with spent acid solution.

Air oxidation of a cupric chloride solution has never been preferred by industry because of its processing inefficiencies. The equation of an air regeneration reaction is:

$$2Cu^{(+1)}Cl + 2HCl + 1/2\ O_2 \rightarrow 2Cu^{(+2)}Cl_2 + H_2O$$

The oxidation reaction using air is much slower than that of chlorine because oxygen is less soluble than chlorine in cupric chloride solution. Moreover, the air oxidation reaction mechanism involves several intermediate steps unlike chlorine oxidation which is a direct bi-molecular reaction.

SUMMARY OF THE INVENTION

In accordance with the present invention, there is provided a method of continuously regenerating a metal containing acid solution enhanced with a salt-free material. The metal dissolved in a bulk metal containing acid solution is continuously oxidized by introducing a gas into a packed reaction vessel. The packed reaction vessel is in operative relationship with the bulk acid solution for recirculating regenerated solution and for receiving spent solution. The gas is introduced substantially cocurrently with the spent acid solution.

BRIEF DESCRIPTION OF THE DRAWINGS

A complete understanding of the present invention may be obtained by reference to the accompanying drawings, when taken in conjunction with the detailed description thereof and in which.

DETAILED DESCRIPTION OF THE PREFERRED EMBODIMENT

Figures 1, 2:
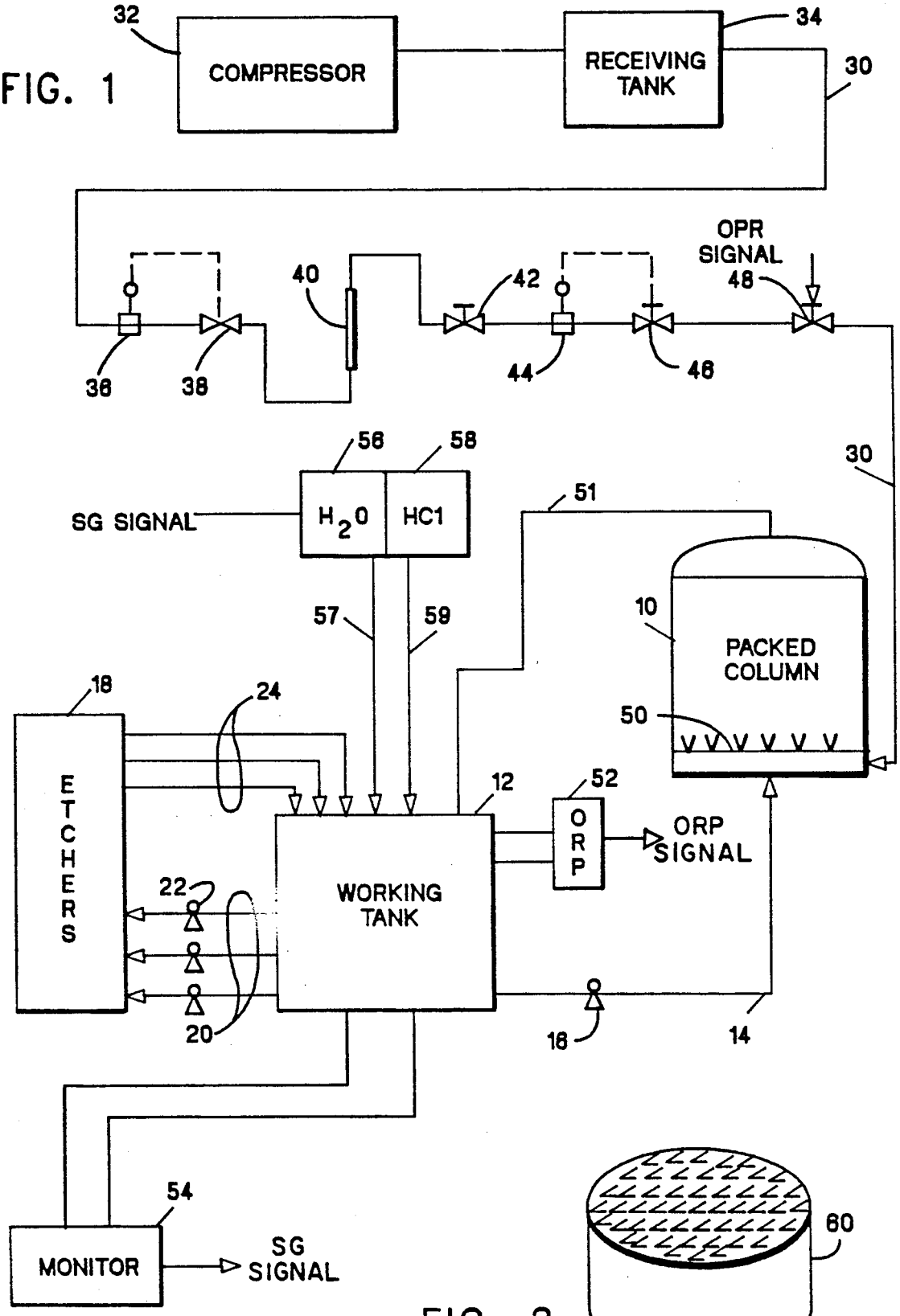
FIG. 1 is an illustration of the scheme employed in regenerating the acid solution.
FIG. 2 is a plastic packing material for use in the packed reaction vessel of the present invention.

Referring now to FIG. 1, there is shown a schematic representation of the apparatus used to carry out the process of the present invention. A cylindrical fiberglass reactor vessel 10, hereinafter referred to as a packed column, is filled with layers of woven packing material, not shown, structured polypropylene acrylonitrile being the preferred material In the preferred embodiment, the industrial system incorporates a cylindrical packed column 10 seven feet high, with a five foot inner diameter. The packed column 10 must be capable of withstanding pressures of up to 75 psia.

A working tank 12 contains cupric chloride etching solution, not shown, and is connected to the packed column 10 by means of a pipe 14 and associated inline pump 16. The tank 12 is connected to etchers 18 by means of outflow pipes 20 and associated inline pumps 22 and by means of inflow pipes 24 by which the etching solution is circulated to and from the etchers 18 respectively.

Also connected to the packed column 10 is an air supply line 30. An air compressor 32 provides air to a receiving tank 34 connected thereto by means of the air supply line 30. The compressor 32 is a standard screw type industrial 40 hp unit available from Joy Manufacturing Co.

The air supply line 30 contains inline meters and control valves to monitor pressure, flow and volume of air. A first pressure switch 36 is connected to the receiving tank 34 upstream of a valve 38. Downstream of the valve 38 on the air supply line 30 is a flowmeter 40, such as is available from the Brooks Instruments Corp. as Model No. 1307. The flowmeter 40 is capable of measuring volumes of 0–150 scfm. Connected downstream of the flowmeter 40 on air supply line 30 is a manual control valve 42. Downstream of the manual control valve 42 on the air supply line 30 is a second pressure switch 44 to which is connected a valve 46 of a non-corrodible material such as titanium. Downstream of the valve 46 on air supply line 30 is an electromechanical redox valve 48 being glass lined in the preferred embodiment. The redox valve 48 is operable by an electrical signal from an oxidation reduction potential meter hereinbelow described in greater detail. The terms redox and oxidation reduction potential (ORP) are used interchangeably herein.

Connected to the redox valve 48 by means of the air supply line 30 are air spargers 50, such as are available from Koch Engineering. The air spargers 50 are manifolds that disperse air evenly through the packed column 10 from the lowermost extremity thereof. In the preferred embodiment, two air spargers 50 are perpendicular to one another, but lie on a plane parallel to the bottom of the packed column 10. They cross at their midpoints, forming an X shape.

A return line 51 is connected between the uppermost extremity of the packed column 10 and the working tank 12.

An oxidation reduction potential (ORP) meter is connected to the working tank 12 by suitable means. The ORP meter 52 indicates, by means of an electrical ORP signal, the amount of cuprous chloride in the etching solution. A suitable ORP meter 52 can be provided by the Leeds and Northrup Corp. as Model No. 7706-9.

A specific gravity monitoring device 54 is connected to the working tank 12 to measure the specific gravity of the solution therein. Such a monitoring device 54 is available from Automation Products, Inc. as Dynatrol density cell Model No. CL-10HY. The monitoring device 54 can produce an electrical SG signal indicative of specific gravity.

A water reservoir 56 and a hydrochloric acid reservoir 58 are also connected to the working tank 12 by means of pipes 57 and 59 respectively and by means of process control instrumentation and valves, not shown, but well known in the art.

The temperature of the solution throughout the system is maintained at 130 degrees F. in the preferred embodiment. The combined volume of the working tank 12 and the packed column 10 is approximately 6500 liters. The flow rate of cupric solution between the working tank 12 and the packed column 10 is 400 to 600 liters per minute. The overall copper concentration of the solution is maintained at approximately 180±30 grams per liter, preferably in a concentration greater than 1.5 moles/liter.

Referring now also to FIG. 2, a layer of packing material shown generally at reference numeral 60 comprises a polypropylene and acrylonitrile composition in a corrugated configuration. The packing material 60 produces a low pressure drop and resists corrosive attack of acidic etching solutions. Moreover, it is lightweight, non-reactive with the acid solution and provides a large interfacial area for mass transfer. Suitable packing material is available from Koch Engineering under the trademark Koch/Sulzer. In the preferred embodiment, each layer 60 is 6.75 inches high and five feet in diameter. This material is stacked in the packed column 10 (FIG. 1), such that the herringbone pattern of each layer is disposed 90 degrees out of phase with the pattern of alternate layers disposed thereon.

In operation, compressed air, not shown, is generated by the compressor 32 and fills the receiving tank 34 over air supply line 30. The air is forced through pressure switch 36, valve 38, flowmeter 40 and manual control valve 42. If the visual indication of the flowmeter 40 is outside the nominal gas flow range, an operator may adjust the flow by adjusting the manual control valve 42 appropriately. In addition, the manual control valve 42 can initiate, terminate or regulate the flow of air when the ORP meter 52 indicates that such action is suitable. The air then proceeds along air supply line 30 to the pressure switch 44, valve 46, redox valve 48, spargers 50 and packed column 10. In the event of a pressure loss in the air supply line 30, the two pressure switches 36 and 44 close valves 38 and 46 respectively to prevent the backflow of cupric chloride solution into the air lines.

The ORP meter 52 allows the concentration of cuprous chloride to reach seven grams per liter before air is charged through the packed column 10. Once the cuprous chloride has been lowered to a concentration of two grams per liter, the ORP meter 52 generates and transmits an ORP electrical signal to close the glass lined redox valve 48 in the air supply line 30. Although it would be ideal to regenerate all of the cuprous chloride completely, two grams per liter provides a realistic operating limit. The etching rate of the solution remains essentially constant within the range of 0 to 2 grams of cuprous chloride per liter and a reduction of the concentration requires an inordinate amount of time.

A portion of the working solution is continuously pumped through the specific gravity monitoring device 54. The etching system is optimized in the preferred embodiment for specific gravity of 1.33 but is allowed to range ±0.06 therefrom. When the etching of copper causes the specific gravity to exceed the high limit, an SG electrical signal is generated by the monitoring device 54 and transmitted to the water and hydrochloric acid reservoirs 56 and 58. A predetermined quantity of water and hydrochloric acid is then added to the working tank 12 through pipes 57 and 59 respectively.

A steady state hydrochloric acid concentration of about 1.5 molar is thus maintained while the specific gravity of about 1.33 is ensured.

Air from the spargers 50 and cupric solution from the working tank 12 travel upward in the packed column 10 cocurrently. The air and solution flow back to the working tank 12 from the top of the packed column 10 by means of the return line 51. The regenerated cuprous solution (now cupric chloride) is now available for and sent to the etchers 18 through outflow pipes 20 while spent cupric solution (now cuprous chloride) is received from the etchers 18 by means of inflow pipes 24.

What has been disclosed is a method of continuously regenerating a metal containing acid solution by oxidizing the solution with air introduced into a packed reaction vessel. The disclosed apparatus is suitable for a sustained, intimate contact of gas and liquid phases to provide a high oxygen mass transfer rate.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A method of continuously regenerating a spent bulk acid solution containing metal ions capable of being continuously oxidized in said solution, said solution being enhanced with a salt-free material, comprising:

receiving said spent bulk acid solution from a working tank;

introducing compressed air into a packed reaction vessel substantially cocurrently with said spent bulk acid solution, to effect oxidation; and recirculating regenerated bulk acid solution from said packed reaction vessel into said working tank.

2. The method in accordance with claim 1 wherein said metal comprises copper.

3. The method in accordance with claim 2 wherein said acid solution comprises cupric chloride.

4. The method in accordance with claim 3 wherein the concentration of said cupric chloride is greater than 1.5 moles/liter.

5. The method in accordance with claim 1 wherein means for sensing metal ion concentration is operatively connected to said bulk acid solution.

6. The method in accordance with claim 5 wherein means for controlling said metal ion concentration is operatively connected to said sensing means.

7. The method in accordance with claim 1 wherein means for sensing gas requirement is operatively connected to said packed reaction vessel.

8. The method in accordance with claim 7 wherein means for controlling the flow of gas is operatively connected to said sensing means.

9. The method in accordance with claim 1 wherein said salt-free material comprises a chloride containing acid.

10. The method in accordance with claim 9 wherein said chloride containing acid comprises hydrochloric acid in a concentration range from about 1 mole/liter to about 3 moles/liter.

11. The method in accordance with claim 1 wherein said acid solution is an etching solution.

12. The method in accordance with claim 1 wherein said packed reaction vessel contains high efficiency packing material.

13. The method in accordance with claim 1 wherein means for etching is operatively connected to said working tank.

* * * * *